United States Patent [19]

Ashkenazi

[11] Patent Number: 4,572,463

[45] Date of Patent: Feb. 25, 1986

[54] TELESCOPIC PROJECTILE AND APPARATUS FOR FIRING SAME

[76] Inventor: Aryeh Ashkenazi, Rehov Yerushalayim 38, Bat Yam, Israel

[21] Appl. No.: 415,696

[22] Filed: Sep. 7, 1982

[30] Foreign Application Priority Data

Sep. 20, 1981 [IL] Israel ..... 63885

[51] Int. Cl.[4] ..... F42B 13/32

[52] U.S. Cl. ..... 244/3.3; 89/1.806; 244/3.29

[58] Field of Search ..... 244/3.27, 3.29, 3.3; 102/347, 433, 434; 89/1.706, 1.817, 1.806

[56] References Cited

U.S. PATENT DOCUMENTS

| | | | |
|---|---|---|---|
| 1,049,144 | 12/1912 | Quisling | 244/3.3 |
| 2,421,752 | 6/1947 | Jones | 244/3.29 |
| 2,437,211 | 3/1948 | Schermuly et al. | 244/3.3 |
| 2,700,337 | 1/1955 | Cumming | 244/3.3 |
| 3,698,320 | 10/1972 | Cochran et al. | 89/1.817 |
| 3,702,588 | 11/1972 | Simmons | 244/3.29 |
| 3,789,729 | 2/1974 | Aupy | 89/1.819 |
| 4,134,328 | 1/1979 | Asp et al. | 89/1.817 |
| 4,158,447 | 6/1979 | Humphries et al. | 244/3.29 |

FOREIGN PATENT DOCUMENTS

| | | | |
|---|---|---|---|
| 0406206 | 10/1943 | Italy | 102/347 |

*Primary Examiner*—Charles T. Jordan

*Attorney, Agent, or Firm*—Browdy and Neimark

[57] ABSTRACT

A telescopic projectile comprising a forward inner portion and a rearward outer portion, the forward inner portion being disposed within the rearward outer portion prior to firing of the projectile and being operative to move forward relative to the rearward outer portion upon firing of the projectile.

5 Claims, 4 Drawing Figures

TELESCOPIC PROJECTILE AND APPARATUS FOR FIRING SAME

FIELD OF THE INVENTION

The present invention relates to projectiles and to firearms generally and more particularly to projectiles having stabilizing fins.

BACKGROUND OF THE INVENTION

Various types of projectiles are known to have stabilizing fins. These projectiles, which include, inter alia, rifle fired grenades, mortar projectiles, rockets and various hollow charge devices useful against armour, are relatively long since they require a forward portion carrying an explosive charge and a rear portion defining the stabilizing fins. The length of the projectiles adds to the weight of both the projectile and of the casing therefor and severely limits the number of projectiles that can be carried by a soldier or by other mechanized means.

SUMMARY OF THE INVENTION

The present invention seeks to provide a projectile having stabilizing fins which is significantly shorter than conventional projectiles of its type.

There is thus provided in accordance with an embodiment of the present invention a telescopic projectile comprising a forward inner portion containing an explosive charge and a rearward outer portion having stabilizing fins formed thereon, the forward inner portion being disposed within the rearward outer portion prior to firing and being operative to move forward relative to the rearward outer portion upon firing thereof. The projectile may be used for a rifle fired grenade, mortar, rocket or any other type of projectile.

Further in accordance with an embodiment of the present invention, the rearward outer portion is formed with a stop configuration at its inner surface for engaging a protruding portion of the forward inner portion for defining the maximum forward position of the forward inner portion relative to the rearward outer portion.

Additionally in accordance with an embodiment of the present invention, the rearward outer portion, together with removable end caps, defines a storage and transport package for the projectile.

BRIEF DESCRIPTION OF THE DRAWINGS

The present invention will be more fully understood and appreciated from the following detailed description taken in conjunction with the drawings in which.

DETAILED DESCRIPTION OF THE INVENTION

Figure 2:
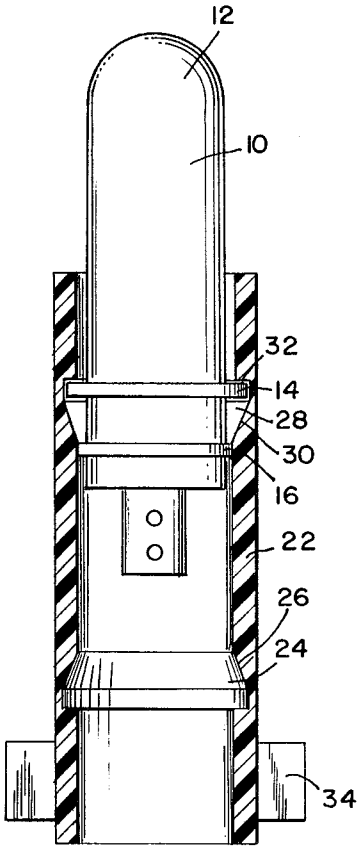
FIG. 2 is a sectional illustration of the telescopic projectile of FIG. 1 in an extended orientation following firing.
Figure 1:
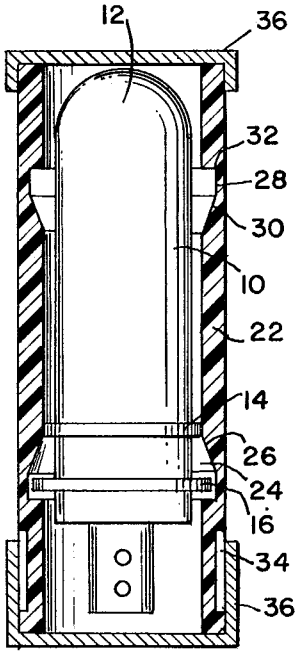
FIG. 1 is a sectional illustration of a telescopic projectile constructed and operative in accordance with an embodiment of the present invention in a retracted orientation prior to firing.

Reference is now made to FIGS. 1 and 2 which illustrate a telescopic projectile constructed and operative in accordance with an embodiment of the present invention. The projectile shown is only one of a number of different types of projectiles which may be constructed and operative in accordance with an embodiment of the present invention. It is therefore appreciated that the invention is not limited to applicability with any given type of projectile, but is applicable to projectiles generally wherever suitable.

The projectile constructed and operative in accordance with the present invention comprises a forward inner portion 10, typically having a rounded or pointed forward configuration and containing an explosive charge 12. Rearward of explosive charge 12 there are provided first and second circumferential protruding rings 14 and 16, which define sealing rings, at least one of which provides a pressure seal between the forward inner portion 10 and an outer rearward portion 22 which will be described hereinafter. A propulsion charge 18 for the projectile may also be provided as indicated.

A rearward outer portion 22 is disposed, in the retracted orientation shown in FIG. 1, in surrounding engagement with respect to inner portion 10 and comprises a hollow tubular element having a generally uniform outer configuration of a circular cylinder. Rearward outer portion 22 is formed with a rearward circumferential inner recess 24 having an inclined forward surface 26 for accomodating protruding ring 14 of the forward inner portion 10. Rearward outer portion 22 is also provided with a forward circumferential inner recess 28 having an inclined rear side surface 30 and a transverse forward surface 32 lying in a plane perpendicular to the longitudinal axis of outer portion 22. Forward circumferential inner recess 28 acts as a stop which limits the forward motion of the inner portion 10 relative to the outer portion 22.

It is noted that when the projectile is in the retracted orientation illustrated in FIG. 1, sealing ring 14 defines a pressure seal between the inner portion 10 and the outer portion 22, while sealing ring 16 protrudes into recess 24 in non-sealing engagement therewith. When the projectile has been fired and is in an extended orientation as seen in FIG. 2, sealing ring 14 engages the stop surface 32 while ring 16 defines a pressure seal.

Disposed rearwardly of the outer surface of the outer portion 22 are a plurality of stabilizing fins 34. The fins 34 are formed of relatively thin bendable metal or other material and are wound about the outer surface of the outer portion 22 when the projectile is in a retracted orientation as seen in FIG. 1.

FIG. 1 also illustrates the provision of end caps 36 which fit over the open ends of the outer portion 22 to define a storage and transport package for the projectile. This arrangement is a particular feature of the present invention, since it eliminates the need for expensive and heavy packaging containers. In accordance with the present invention, the outer portion 22 defines the packaging container together with the end caps 36.

Reference is now made to FIG. 2 which illustrates the projectile in its fully extended orientation after firing. It is seen that circumferential protruding ring 14 is seated in the forward circumferential inner recess 28;

that the fins 34 are extended radially; and that ring 16 defines a seal.

The firing mechanism and operation will now be described with reference to FIGS. 3 and 4.

Figure 4:
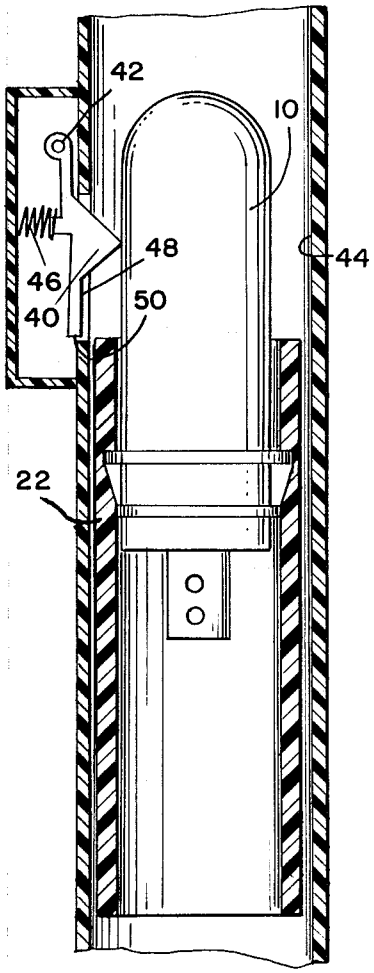
FIG. 4 is a sectional illustration of the apparatus of FIG. 3 in a second projectile engaging orientation immediately following firing.
Figure 3:
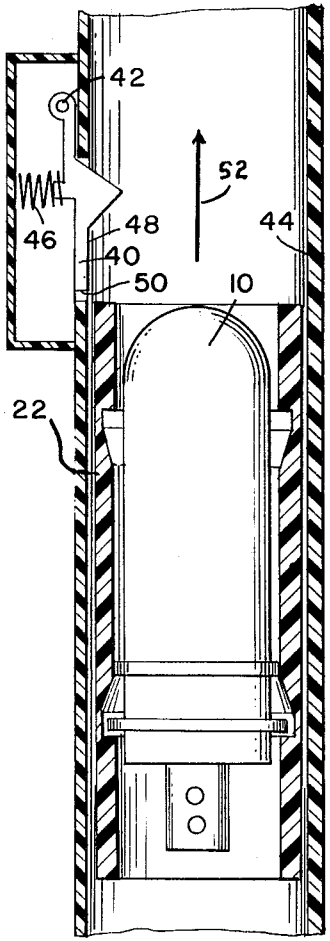
FIG. 3 is a sectional illustration of a portion of the firing apparatus for a projectile such as that shown in FIGS. 1 and 2, including selectable retaining apparatus disposed in an initial projectile engaging orientation.

FIGS. 3 and 4 illustrate a portion of a firing mechanism for projectiles constructed and operative in accordance with an embodiment of the present invention. The remainder of the firing mechanism, including the firing impact mechanism is not shown since it is entirely conventional. The illustrated apparatus provides selectable retaining of the outer portion 22 of the projectile, and comprises at least one retaining finger element 40 which is pivotably mounted about an axis 42 fixed with respect to the barrel 44 of the firing apparatus. The retaining finger element 40 is normally urged into retaining engagement interiorly of the barrel by means of a compression spring 46 which is seated between the retaining finger element 40 and a spring seat fixed with respect to the barrel.

FIG. 3 illustrates the pre-firing orientation of the projectile in the barrel. In this orientation, the extreme end 50 of the retaining finger element abuts the end surface of the outer portion 22 and prevents forward motion of the outer portion during the initial stages of firing. In such a way, all of the force imparted to the projectile initially during firing is applied to the inner portion 10 which moves forward against the outer portion. This initial force temporarily compresses protruding ring 14 and forces the inner portion forwardly until the outer portion is released by the retaining finger element. The release of the outer portion by the retaining finger element is timed to coincide with the engagement of the protruding ring with forward circumferential inner recess 28. In order to shorten the required distance between the retaining finger element from the base of the projectile, the projectile may be formed with a tapered or two stage surface which is arranged such that only a relatively rearward portion thereon engages the cam surface 48.

FIG. 4 illustrates the operation of the retaining finger element in releasing the outer portion 22 of the projectile. It is noted that the retaining finger element 40 is formed with a cam surface 48 which is engaged by the inner portion 10 as it moves forward relatively to the outer portion 22. Finger element 40 is oriented and cam surface 48 is configured such that when the inner portion 10 reaches a position whereby the protruding ring 14 is seated in forward circumferential inner recess 28, the extreme end 50 moves out of abutting engagement with the end surface of outer portion 22 and thus allows forward motion of the outer portion of the projectile. The projectile thus moves forwardly in a direction indicated by arrow 52 and leaves the barrel. Fins 34 unwind and extend radially once the projectile leaves the barrel due to their inherent bending moment.

It will be appreciated by persons skilled in the art that the invention is not limited to what has been particularly shown and described hereinabove. Rather the scope of the present invention is defined only by the claims which follow.

I claim:

1. A telescoping projectile comprising:

a forward inner portion containing an explosive charge;

a rearward outer portion;

said forward inner portion being disposed within said rearward outer portion prior to firing of said projectile and being operative to move forward relative to said rearward outer portion upon firing of said projectile; said rearward outer portion being formed with an inner surface defining a stop configuration; and said forward inner portion defining at the rearward portion thereof forward and rearward circumferential sealing rings, said forward circumferential sealing ring being arranged to engage said stop configuration at the maximum forward position of said forward inner portion relative to said rearward outer portion; said rearward circumferential sealing ring being operative to provide a pressure seal between said forward inner portion and said rearward outer portion when said forward circumferential sealing ring is disposed adjacent said stop configuration, whereby at least one of said forward and rear sealing rings provides a pressure seal between said forward inner portion and said rearward outer portion at all relative positions thereof.

2. A telescopic projectile according to claim 1 and wherein said rearward outer portion comprises stabilizing fins.

3. A telescopic projectile according to claim 1 and wherein said rearward outer portion is operative to provide protective packaging for said projectile.

4. A telescopic projectile according to claim 3 and also comprising end caps which are removably attached at the ends of the rearward outer portion.

5. A telescoping projectile according to claim 1 and wherein said rearward outer portion comprises stabilizing fins formed of thin bendable metal which are wound about the outer surface of said rearward outer portion prior to firing of said projectile and extend radially outward following firing thereof.

* * * * *